US005081902A

United States Patent [19]

Rausch

[11] Patent Number: 5,081,902

[45] Date of Patent: Jan. 21, 1992

[54] APPARATUS FOR PROVIDING RELIEF TO A WORKING CHAMBER

[75] Inventor: Georg Rausch, Lohr, Fed. Rep. of Germany

[73] Assignee: Mannesmann Rexroth GmbH, Lohr, Fed. Rep. of Germany

[21] Appl. No.: 549,945

[22] Filed: Jul. 9, 1990

[30] Foreign Application Priority Data

Jul. 8, 1989 [DE] Fed. Rep. of Germany ..... 39222553

[51] Int. Cl.[5] ..... F15B 13/02

[52] U.S. Cl. ..... 91/47; 91/443; 91/449; 91/461

[58] Field of Search ..... 91/47, 51, 304, 443, 91/449, 461

[56] References Cited

U.S. PATENT DOCUMENTS

| | | | |
|---|---|---|---|
| 3,376,792 | 4/1968 | Clarke et al. | 91/461 X |
| 3,452,645 | 7/1969 | Barltrop | 91/461 X |
| 3,906,838 | 9/1975 | Hofer | 91/461 X |
| 4,687,177 | 8/1987 | Hartwig | 91/443 X |
| 4,811,649 | 3/1989 | Heusser | 91/47 |
| 4,955,283 | 9/1990 | Hidaka et al. | 91/461 X |

FOREIGN PATENT DOCUMENTS

| | | | |
|---|---|---|---|
| 2542665 | 5/1977 | Fed. Rep. of Germany . | |
| 2814301 | 10/1979 | Fed. Rep. of Germany . | |
| 3440849 | 5/1986 | Fed. Rep. of Germany . | |
| 3602362 | 7/1987 | Fed. Rep. of Germany . | |
| 0005503 | 1/1983 | Japan | 91/461 |

*Primary Examiner*—Look Edward K.
*Assistant Examiner*—John Ryznic
*Attorney, Agent, or Firm*—Cushman, Darby & Cushman

[57] ABSTRACT

For the relief of a highly pressurized hydraulic liquid in a working chamber of pilot controlled 2/2 poppet valve is used. The working chamber is further connected to a pressure relief valve, the output of which is connected to a control conduit extending between a control chamber of the 2/2 poppet valve and the pilot valve. The apparatus of the invention requires a shorter period of time for the pressure relief without the danger of relief noise.

10 Claims, 1 Drawing Sheet

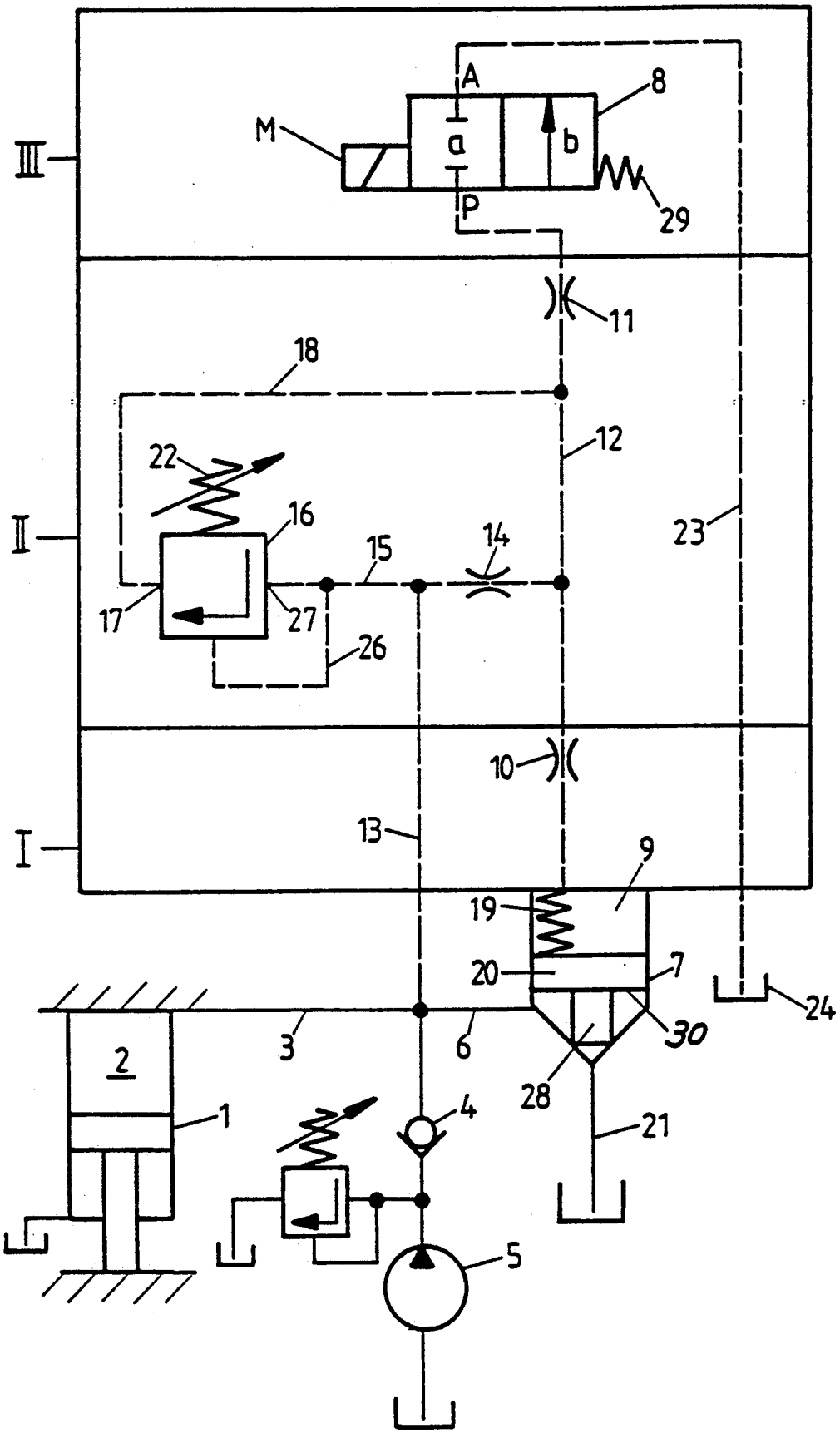
III
II
I
M
A
a
b
P
8
29
11
18
12
22
16
15
14
23
17
27
26
10
13
9
19
20
7
24
30
3
6
2
1
28
21
4
5

APPARATUS FOR PROVIDING RELIEF TO A WORKING CHAMBER

BACKGROUND OF THE INVENTION

This invention relates to an apparatus for providing relief to an operating chamber of a hydraulic unit which is under high pressure. More specifically, the invention relates to such an apparatus for the working chamber of a hydraulic cylinder.

It is known to provide pressure relief (decompression or venting operation) by means of a pilot actuated 2/2 control valve (a so-called poppet valve or logic unit). So as to avoid a relief noise or relief blows, the opening movement of the poppet of the 2/2 control valve has to occur with a speed as low as possible. For that purpose the pilot oil which is used for the actuation of the control poppet of the main or poppet valve is removed from the control chamber of the 2/2 poppet valve via a correspondingly small dimensioned fixed throttle or orifice. This kind of pressure relief requires a relatively long time until the pressure in the working chamber reaches the level of the tank pressure.

SUMMARY OF THE INVENTION

An object of the present invention is to provide an apparatus for the relief (venting) of pressure from a working chamber such, that the time is kept short which is necessary for the highly pressurized working chamber to achieve the level of the tank pressure. The venting operation should occur without taking the risk that relief noise or relief blows occur.

According to an aspect of the invention an apparatus is provided for allowing pressure relief for a working chamber which is under high hydraulic pressure. That apparatus comprises a pilot controlled 2/2 poppet valve. The pilot controlled 2/2 poppet valve comprises a control chamber (in which a control pressure acts) as well as a poppet (i.e. a control spool having a closing member). Between the control chamber of the 2/2 poppet valve and the pilot valve a (first) throttle is located. The area (also called control surface) of the poppet subjected to the pressure in the control chamber is larger than the area of the poppet which is subjected to the user pressure. The control pressure acts in the direction of closing said 2/2 poppet valve while the user pressure acts in the direction of opening said poppet. The working chamber is additionally connected to a pressure relief valve. The output of said pressure relief valve is connected to the control connection which extends between the control chamber of the 2/2 poppet valve and the pilot valve.

The additional connection of the working chamber to the pressure relief valve causes—at the time the pilot valve is switched—initially a relief of the pressure chamber to a pressure value to which the pressure relief valve is adjusted. During that operation the pressure medium or working liquid flows via the pressure relief valve and via the pilot valve to the tank. During said first relief phase the main valve (i.e. the 2/2 poppet valve) still remains closed due to the connection to the pilot valve, because there is a build-up of pressure due to the working liquid flowing across the pressure relief valve. This is due to the fact that the control surface of the poppet which is subjected to said pressure build-up is larger than the annular surface or area of the poppet which is subjected to the working pressure of the user. As soon as the pressure build-up has reached a value which is no longer sufficient to keep the poppet in its closing position, a second relief phase is initiated. For the second relief phase the poppet opens the connection between the working chamber and the tank. The opening speed of the poppet is determined by the flow-cross-section of the first throttle assigned to the control chamber of the poppet valve. The control liquid displaced from the control chamber of the poppet valve during the opening movement of the poppet flows across said first throttle. Due to the existence of said two phases of relief the time required for the pressure relief of the user can be adjusted to an optimum value without having to be afraid of a relief blow or relief noise.

Preferred embodiments of the invention are disclosed in the dependent claims.

BRIEF DESCRIPTION OF THE DRAWINGS

The apparatus of the invention is shown in the accompanying single FIGURE showing a circuit diagram of the apparatus of the invention.

The FIGURE shows a user in the form of a hydraulic cylinder 1. The hydraulic cylinder 1 comprises a working chamber 2 connected via a working conduit 3 to a check valve 4, which in turn is connected to the pressure side of a pump 5. A conduit 6 branches-off said working conduit 3 and extends towards the input of a 2/2 control or poppet valve 7. The poppet valve 7 has a poppet which in turn comprises a control spool 20 and a closing member 28. The 2/2 poppet valve (poppet unit) has two switching or operating positions, namely an open position and a closed position. The 2/2 poppet valve is a so-called logic valve and is hydraulically controlled by means of a pilot valve 8. Details about a poppet valve can be found on pages 4–28 through 4–36 and 5–56 through 5–68 of the book entitled "USING INDUSTRIAL HYDRAULICS", published by HYDRAULICS & PNEUMATICS Magazine, Cleveland, Ohio 44114. The 2/2 poppet valve comprises a control chamber 9 which is connected via a first throttle 10 and a first additional throttle 11 to the P-port of the pilot valve 8. This connection is provided by a control conduit 12 within which the two throttles 10 and 11 are located. Control or pilot liquid is taken from the pump conduit 3 by means of a pilot conduit 13 and is supplied via a second additional throttle 14 to the pilot conduit 12. From there, the pilot liquid passes to the control chamber 9 via said first throttle 10. A pilot conduit section 15 leads from the pilot conduit 13 to a pressure relief valve 16. The output 17 of said pressure relief valve 16 is connected to a pilot conduit 18 which in turn is connected to the pilot conduit 12.

The pilot control valve 8 has two (switching) positions referred to "a" and "b". The pilot valve 8 is shown in its closed position "a" which will be assumed if the solenoid M is energized. In the position "a" of the pilot valve 8 the poppet, and specifically its closing member 28, is maintained in its closing position and thus, the connection of the working conduit 6 to the tank conduit 21 is blocked. The closing member 28 is kept in its closing position due to the pilot pressure acting in the control chamber 9 and upon the control spool 20 together with the force of a closing spring 19.

The pressure relief valve 16 remains in its closing position until the working pressure, which acts against the force of a pressure spring 22 via a control conduit section 26, reaches the pressure value for which the closing spring 22 is adjusted. As soon as this situation occurs and the working pressure goes beyond the pressure value adjusted at the pressure spring 22, the pressure relief valve 16 opens and connects its input 27 with its output 17.

In case that the pilot valve 8 is moved from the closed position "a" (as shown) into its connecting position "b" by means of the pressure spring 29, because the solenoid M is de-energized—and thus a connection is provided via the port A and the control conduit 23 to the tank 24—the working liquid flows from the working chamber 2 to the tank via: the working conduit 3, the control conduit 13, the pressure relief valve 16, the control conduit 18, the first additional throttle 11 in the control conduit 12, the pilot valve 8, and the control conduit 23. The amount of liquid flowing to the tank 24 is limited by the free cross-section of the throttle 11. Thus, simultaneously, there will be a pressure build-up in the control conduit 12. This pressure build-up will act upon the control chamber 9 via the throttle 10 and will initially hold the poppet, i.e. the closing member 28 in its shown closed position. As soon as the pressure in the working chamber 2 has decreased so far that the pressure relief valve 16 closes in accordance with its adjusted pressure, and thus no working liquid will be supplied to the control conduit 12, the pressure build-up in the control conduit 12 and, consequently, also in the control chamber 9 decreases. As a consequence the working pressure acting upon the annular surface or area 30 of the control spool 20 (of the poppet) acts upon the closing body 28 against the small force exerted by the closing spring 19 and moves said poppet, i.e. the closing body 28 into the opening direction and thus a direct connection between the working chamber 2 and the tank port 21 is provided, so that the remaining relief occurs for the working chamber 2. The speed of the opening movement of the poppet, i.e., the closing member 28 is determined by the free cross-section of the throttle 10 or, in case such a throttle is not provided, by the throttle 11. This is so, because the control liquid displaced during the opening movement of the closing body 28 has to passed across said throttle to the tank 24.

Initially, by means of the pressure relief valve 16, the high pressure in the working chamber 2 is decreased to an intermediate pressure is determined by the inner resistance of the pressure relief valve 16. The removal or venting of the remaining pressure via the 2/2 poppet valve 7 can be carried out quickly, in as much as a relief shock is not expected in the lower pressure range.

Therefore, in contrast to the prior art the first throttle 10, which determines the opening speed of the closing member 20 of the 2/2 poppet valve 7 can be of relatively large design or can be deleted altogether, thus correspondingly increasing the speed of the opening operation of the 2/2 poppet valve 7. It is thereby possible to limit to a small period of time the total time required for the relief of the working chamber 2.

Instead of connecting the outlet 17 of the pressure relief valve 16 via the control conduit 18 to the control conduit 12 and thus to the pilot valve 8, it is also possible to connect the control conduit 18 via a separate 2/2 control (poppet) valve to the tank. In this case a matching or tuning operation between the additional 2/2 poppet valve and the pilot valve would have to be carried out in such a manner that initially said additional poppet valve is switched into its open or passing position for removing the working fluid via the pressure relief valve, and, thereupon, the pilot valve 8 for the 2/2 poppet valve (logic valve) 7 is switched into its open or passing position.

The relief apparatus of the invention is preferably formed by three plate structures I, II, and III. Plate structure I is adapted to receive the logic valve 7, plate structure II is adapted to receive the pressure relieve valve together with the two throttles 14 and 11, and the plate structure III is adapted to receive the pilot valve 8.

The throttle cross-section of the second additional throttle 14 is smaller than the flow cross-section of the first additional throttle 11. This assures that a sufficient pressure build-up occurs in the conduit 12 when the pressure relief valve 16 is in its open position so as to maintain the closing body 20 in its closing position. It is also assured that in the closed position of the pilot valve 8 control liquid for closing the closing body 20 can be supplied from the user and from the pump, respectively, via the throttle 14. It is possible not to use the throttle 10 if the second phase of relief is to occur very fast.

What is claimed is:

1. An apparatus for providing relief to a working chamber filled with a highly pressurized hydraulic liquid, said apparatus comprising:

a pilot controlled 2-way, 2-position poppet valve, said valve having a control chamber and control spool together with closing body, a pilot valve, a throttle means arranged between said control chamber of said 2-way, 2-position poppet valve and the pilot valve, wherein the surface area of the 2-way, 2-position control spool, which is subjected to the control or pilot pressure, is larger than the surface area of the control spool which is subjected to a user pressure, and the pilot pressure acts in a closing direction of the control spool while the user pressure acts in an opening direction of said control spool, and a pressure relief valve having an input and an output, said pressure relief valve being connected via said input to said working chamber and further via said output to a control conduit extending between the control chamber of the 2-way, 2-position poppet valve and the pilot valve.

2. The apparatus of claim 1 wherein a first additional throttle is provided between the pilot valve and the connecting point of the output of the pressure relief valve with the control conduit.

3. The apparatus of claim 2 wherein a second additional throttle is provided between the working chamber and the control chamber of the 2-way 2-position pilot valve.

4. The apparatus of claim 3 wherein the second additional throttle is connected via said first throttle to the control chamber of the 2-way, 2-position pilot valve.

5. The apparatus of claim 3 wherein the flow cross-section of the second additional throttle is smaller than the flow cross-section of the first additional throttle.

6. The apparatus of claim 3 wherein the pressure relief valve together with the first and the second additional throttles are provided in the form of (a) a second sandwich plate (ii) including the respective control channels, (b) a first plate including the 2-way, 2-position poppet valve (7) together with the first throttle (10), and (c) a third plate including said pilot valve.

7. A hydraulic circuit arrangement comprising:

a hydraulic pump, a hydraulic cylinder having at least one working chamber, a pilot operated two-way operated two-way poppet valve comprising a poppet, said valve being adapted to connect said working chamber to a tank, a pilot valve connect to a control chamber of said poppet valve and adapted to let the poppet valve assume its open or closed position, a spring for biasing said poppet of said poppet valve into its closed position, a pressure relief valve having an input and an output, the input of the pressure relief valve being connected to the control chamber of said poppet valve and the output of the pressure relief valve being connected to a control conduit connecting said control chamber to the pilot valve, and a throttle located in said control conduit connecting said control chamber with said pilot valve.

8. The hydraulic circuit of claim 7 wherein a first additional throttle is located in said control conduit in series with said first throttle.

9. The circuit arrangement of claim 7 wherein a second additional throttle is provided between the output of the pressure relief valve and the pilot valve.

10. The hydraulic circuit of claim 8 wherein a second additional throttle is provided between the input of the pressure relief valve and a point of the control conduit between said first throttle and said first additional throttle.

* * * * *